United States Patent [19]

Gugel et al.

[11] Patent Number: 5,039,239

[45] Date of Patent: Aug. 13, 1991

[54] MATRIX PIN-PRINT HEAD OF THE HINGED-CLAPPER-ARMATURE CONSTRUCTION

[75] Inventors: Bernd Gugel, Ulm-Einsingen; Johann Stempfle, Pfaffenhofen, both of Fed. Rep. of Germany

[73] Assignee: Mannesmann Aktiengesellschaft, Düsseldorf, Fed. Rep. of Germany

[21] Appl. No.: 387,607

[22] Filed: Jul. 28, 1989

[30] Foreign Application Priority Data

Aug. 1, 1988 [EP] European Pat. Off. ..... 88730170.3

[51] Int. Cl.[5] ..... B41J 3/12

[52] U.S. Cl. ..... 400/124; 101/93.05

[58] Field of Search ..... 400/124; 101/93.05

[56] References Cited

U.S. PATENT DOCUMENTS

| | | | |
|---|---|---|---|
| 4,407,591 | 10/1983 | Adamoli et al. | 400/124 |
| 4,548,521 | 10/1985 | Wirth et al. | 400/124 |
| 4,600,321 | 7/1986 | Kwan | 400/124 |
| 4,626,115 | 12/1986 | Norigoe | 400/124 |
| 4,648,730 | 3/1987 | Cattaneo | 400/124 |
| 4,723,854 | 2/1988 | Sakaida et al. | 400/124 |

FOREIGN PATENT DOCUMENTS

| | | | |
|---|---|---|---|
| 0110662 | 6/1984 | European Pat. Off. | 400/124 |
| 60-67170 | 4/1985 | Japan | 400/124 |

*Primary Examiner*—Edgar S. Burr
*Assistant Examiner*—Ren Yan
*Attorney, Agent, or Firm*—Horst M. Kasper

[57] ABSTRACT

An armature (4) is coordinated to each print pin (1) with a pin guide case (9) and in a coil support case (14) an electromagnetic coil (3) and magnet yokes (3*a*, 3*b*) in a matrix pin print head. In order to improve the system of the individual armatures (4) and their support, all armatures (4) are maintained in operations with a shaped sheet metal (19, 19*a*) and are connected thereby to each other and thereby form a unit (4, 19). Thus unit (4, 19) is centered via in the pin guide case (9) via several cogs (25), distributed over the circumference, and cogs are provided, which center this unit (4, 19) also in a coil support case (14).

12 Claims, 3 Drawing Sheets

MATRIX PIN-PRINT HEAD OF THE HINGED-CLAPPER-ARMATURE CONSTRUCTION

BACKGROUND OF THE INVENTION

1. Field of the Invention

The invention relates to a matrix pin print head of the hinged clapper armature construction, including an electromagnetic coil armature system coordinated to each print pin, where the armatures are coordinated to a pin guide case, and the electromagnetic coils or, respectively, magnet yokes are coordinated to a coil support case connectable to the pin guide case.

2. Brief Description of the Background of the Invention Including Prior Art

Such a hinged clapper armature system is conventionally manufactured from several parts and thus economically dependent on the production of the individual parts, on the mounting and on the operating precision and reliability of the parts. In conventional hinged clapper armature systems, such as described for example in German Patent DE No. 3,412,856 C2, the armatures are produced as individual pieces and are individually mounted. Each hinged clapper armature requires its own bearing support, which allows it a precise tilting motion with as little play as possible. Support faces in the pin guide case form bearing supports and the front faces of the magnet yokes form opposite, at a precise distance, further support faces. The bearing support is formed on the side by steps or overlapping protrusions, in order to prevent a lateral displacement during the tilting motion, compare U.S. Pat. No. 4,640,633.

Such a system becomes a problem when an increasing number of the electromagnetic coil armature systems are coordinated to each print pin. In this context, one considers seven, nine, eighteen, and twenty-four pin systems, so that with an increasing number of print pins, there is also generated a spatial or location problem, if it is to be avoided that the outer diameter of the print head becomes larger and larger.

The individually produced armatures, however, cannot be produced to have a completely identical shape and property. Similarly, the bearing supports are not identical. It would be cumbersome, time-consuming and, consequently, too expensive to compare the tolerances of the bearing supports with those of the hinged clapper armatures and to select suitable pairs.

SUMMARY OF THE INVENTION

1. Purposes of the Invention

It is an object of the present invention to improve the system of the hinged clapper armatures and its support in a matrix pin print head of a hinged clapper armature construction.

It is another object of the invention to provide a matrix pin print head, where the alignment of the armatures is provided reliably and precisely.

It is yet a further object of the present invention to provide a magnet matrix pin print head, where the angular precision of the position of the armatures is very high.

These and other objects and advantages of the present invention will become evident from the description which follows.

2. Brief Description of the Invention

The present invention provides for a matrix pin print head of a hinged clapper armature construction. A coil support case is connectable to a pin guide case. A set of electromagnetic coils is coordinated to a coil support case and distributed over a substantially circular circumference. A set of magnet yokes is coordinated to the set of electromagnetic coils and coordinated to a coil support case. A plurality of cogs is distributed along the circumference and disposed in the pin guide case. A set of hinged clapper armatures is coordinated to the set of electromagnetic coils and coordinated to a pin guide case. All armatures of the set of armatures are maintained, relative to each other, in operating position, and are connected to each other by way of a shaped sheet metal part, and form a unit. This unit of armatures and shaped sheet metal part is centered via several cogs of the plurality of cogs, distributed over the circumference, in the pin guide case. The cogs are furnished in the coil support case for centering said unit of armatures and sheet metal part. A set of print pins is coordinated to the sets of electromagnetic coils and attached to the set of armatures.

The cogs, for centering the unit of set of armatures and sheet metal part in the pin guide case, can be constructed for simultaneously centering the unit in the coil support case. The cogs can be supported immediately on a joint planar face of the magnet yokes with a support face of the cogs.

The unit of armatures and sheet metal part can rest with a planar shaped sheet metal part on a planar face of the magnet yokes.

According to the invention, all armatures are maintained in operating position relative to each other by way of a shaped sheet metal part, and are connected to each other and form a unit, such that this unit is centered via several cogs distributed over the circumference in the pin guide case and that cogs are provided, which also center this unit of the hinged clapper armatures and shaped sheet metal part in the coil support case. A first advantage according to the invention is associated with the possibility of dispensing with the production of individual hinged clapper armatures and in that all armatures assume a precise position, which is unchangeable relative to the other hinged clapper armatures. The unit formed of the hinged clapper armatures and of the shaped sheet metal part can now be fixed in position easier than is the case with individual hinged clapper armatures. According to a further advantage, the recited unit can be fixed and centered in the pin guide case as well as in the coil support case by way of the cogs. Thus, a permanent precise support is created. In principle, even three cogs, distributed over the circumference, are sufficient in order to obtain a centering of the unit of armature and shaped sheet metal part.

According to a further feature, it is provided that the cogs, centering the unit of hinged clapper armatures in the pin guide case, center simultaneously the unit in the coil support case. This construction requires consequently only one single type of cog.

In addition, the precision of the centering is further increased by having the cogs supported with a support face immediately on the joint planar face of the magnet yokes.

A particularly advantageous embodiment of the cogs exists if the unit of armatures rests with a planar shaped sheet metal part on the planar face of the magnet yokes. Tests have proven that the support of the shaped sheet metal part, in particular in this assembled condition, results in a low-loss system. In this case, the hinged clapper armature performs, on the side of the magnet yoke, its own separate pivoting motion. In addition, the pivoting motions of neighboring armatures remain without any influence.

The novel features which are considered as characteristic for the invention are set forth in the appended claims. The invention itself, however, both as to its construction and its method of operation, together with additional objects and advantages thereof, will be best understood from the following description of specific embodiments when read in connection with the accompanying drawing.

BRIEF DESCRIPTION OF THE DRAWING

In the accompanying drawing, in which are shown several of the various possible embodiments of the present invention.

DESCRIPTION OF INVENTION AND PREFERRED EMBODIMENT

Figure 1:
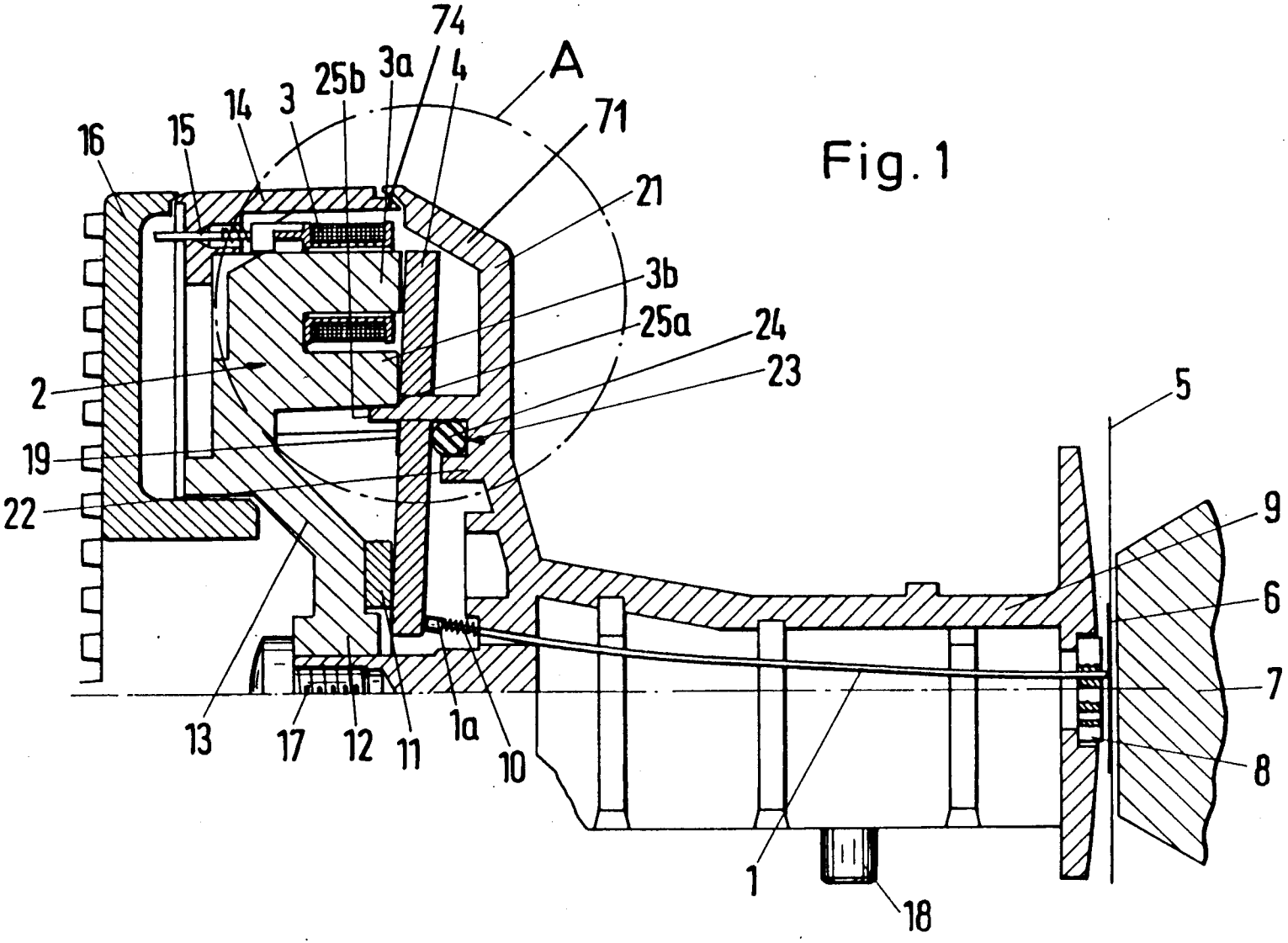
FIG. 1 is a partial axial sectional view through the matrix print head.

In accordance with the present invention, there is provided a matrix pin print head of the clapper armature construction, with an electromagnetic coil armature system 2 coordinated to each print pin 1. Armatures 4 are coordinated to a pin guide case 9 and the electromagnetic coils 3 or, respectively, magnet yokes 3*a*, 3*b* are coordinated to a coil support case 14 connectable to the pin guide case 9. All armatures 4 are maintained, relative to each other, in operating position, and are connected to each other by way of a shaped sheet metal part 19 and form a unit 4, 19. Said unit 4, 19 of armatures and shaped sheet metal part is centered via several cogs 25, distributed over the circumference, in the pin guide case 9. The cogs 25 are furnished in the coil support case 14 for centering said unit 4, 19 of armatures and sheet metal part.

The cogs 25, for centering the unit 4, 19 of armatures and sheet metal part in the pin guide case 9, can simultaneously center the unit 4, 19 in the coil support case 14. The cogs 25 can be supported immediately on a joint planar face 27 of the magnet yokes 3*a*, 3*b* with a support face 25*a*.

The unit 4, 19 of armatures and sheet metal part can rest with a planar shaped sheet metal part 19*a* on the planar face 27 of the magnet yokes 3*a*, 3*b*.

The matrix print head is furnished with an electromagnetic coil armature system 2 coordinated to each print pin 1. Each print pin 1 is driven by an electromagnetic coil 3, magnet yokes 3*a* and 3*b* with hinged clapper armatures 4, in order to generate on a record carrier 5 print points and thus characters via an ink ribbon 6, where the record carrier 5 and the ink ribbon 6 both in turn rest on a print counter support 7. Print pins 1 can be provided in one or several slots with seven, nine, eighteen, twenty-four, or a larger number of pins. The print pins 1 are guided in a print pin guide 8, where this print pin guide 8 is supported at the output of a print pin guide case 9, as illustrated in FIG. 1. The print pins 1 are normally stationary disposed in the illustrated rest position, in which rest position neither the ink ribbon 6 nor the record carrier 5 are contacted, while a pin head 1*a* is subjected to the force of a spring 10 against the respective hinged clapper armature 4. Simultaneously, all armatures 4 are supported against a damper ring 11, made of an elastic material. The damp ring 11 is attached at a single-piece magnet yoke body 13, forming a hub 12 relative to the magnet yokes 3*a*, 3*b*. The magnet yoke body 13 is part of a coil support case 14, where current connection terminals 15 are installed for the electromagnetic coils 3, and which coil support case 14 is closed by a cover 16 furnished with cooling ribs. The pin guide case 9 and the coil support case 14 are held together, in a fixed relative position, by a screw 17.

The complete matrix pin print head is attached, in the finished state, with alignment pins 18 on a slider, movable back and forth in parallel to the print counter support 7.

Figure 3:
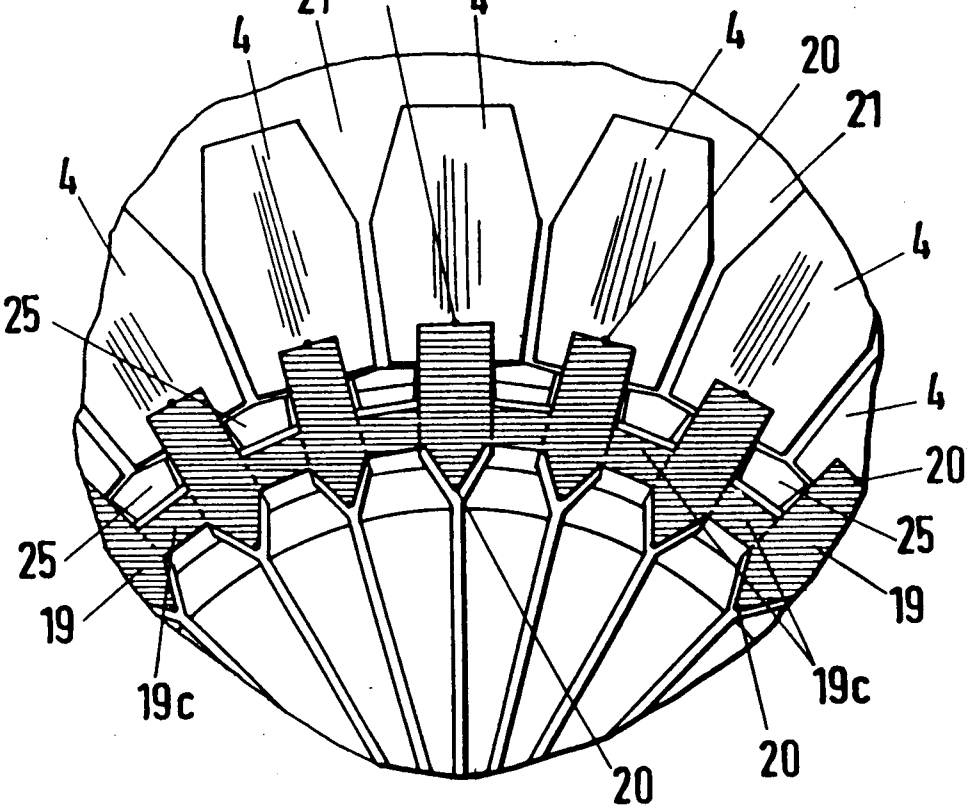
FIG. 3 is a side view of the detailed view A of FIG. 1.
Figure 2:
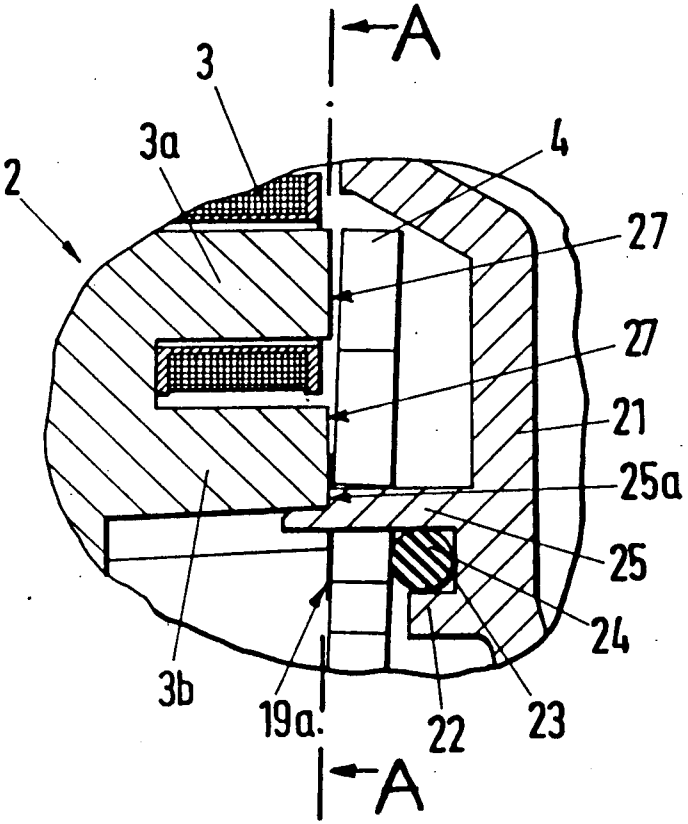
FIG. 2 is a detailed sectional view of the region designated with A in FIG. 1 of the cross-section indicated by section line A—A of FIG. 3, at an enlarged scale.
Figure 4:
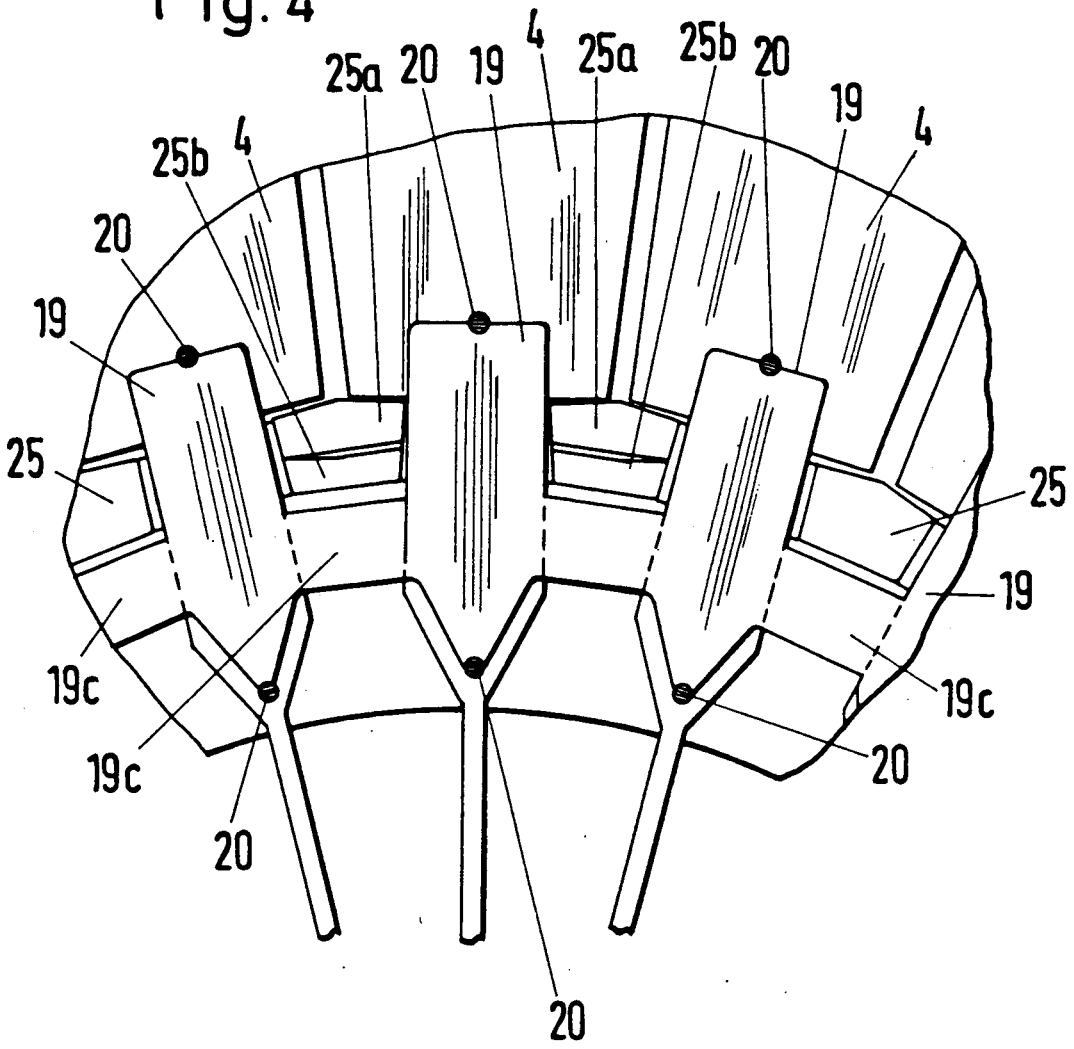
FIG. 4 is a further enlarged section of the side view according to FIG. 3.

All armatures, as illustrated in FIGS. 2 and 3, are held together, already as a result of the method of their production, by way of a single-piece shaped sheet metal part 19. The shaped sheet metal part 19 is attached by welding points 20 on the armatures 4. FIG. 2 illustrates clearly the thickness ratio of the armature 4 relative to the shaped sheet metal part 19. The shaped sheet metal part 19, for practical purposes, has a thickness of 0.05 mm. The pin guide case 9 forms a shell 21 disposed toward the coil support case 14. The shell 21 forms a flange 22 with a circumferentially surrounding annular recess 23 for an O-ring 24, made of a relatively elastic material. The recess 23 is furnished radially at the outer side with cogs 25, to be described in more detail. For the centering of the unit 4, 19 of the armatures and shaped sheet metal part, in each case, separate step-forming support faces 25*a* and 25*b* of the cogs 25 can be furnished, as illustrated in FIGS. 3 and 4. The cogs 25, centering the unit 4, 19 of armatures and shaped sheet metal part in the pin guide case 9, can however also, as illustrated, center simultaneously the unit 4, 19 of armatures and shaped sheet metal part in the coil support case 14. For this purpose, the cogs 25 support themselves from the inside with a step-forming support face 25*a* passing on the side at the shaped sheet metal part 19 on a joint planar face 27 of all magnet yokes 3*a* or, respectively, 3*b*. In this case, it is advantageous if the shaped sheet metal part 19 is furnished as a completely planar shaped sheet metal part 19*a*. From FIG. 3, it can be gathered that at the armature 4, i.e. the armature illustrated in the middle, the cogs 25 rest without any play. In contrast, the armatures 4, illustrated respectively on the left or on the right of the "center" armature, are disposed with a play relative to the cogs 25. Thus, an alignment means is available for positioning the armatures relative to the magnet yokes 3*a*, 3*b*.

The shaped sheet metal part 19 or, respectively, 19*a*, can also be furnished as a leaf spring. It then acts like a foil. Upon feeding current to the electromagnetic coil 3, the armature 4 performs a pure pivoting motion on the side of the magnet yokes 3*a*, 3*b*. In this connection, there occurs radially a minimum slide motion within a range of tenths of a micrometer. This motion is received by the O-ring 24 formed of rubber. A wedge-shaped air gap is generated between the armature 4 and the magnet yokes 3*a*, 3*b*, which air gap disappears in the case of current passage, such that the armature 4 rests completely planar, parallel, and flat on the magnet yokes 3*a* and 3*b*, without over-shooting oscillation. An over-shooting oscillation is prevented by a restoring force via the cross-sections of the connection webs 19c, as illustrated in FIGS. 3 and 4. Nevertheless, the matrix pin print head can be operated at a high frequency.

The cross-section of the cog 25 can match substantially an opening provided by armature 4 and shaped sheet metal part 19 between two armatures. Preferably, the cog 25 is disposed on the side of webs 19c forming the shaped sheet metal part 19 and the armatures 4 being attracted at the electromagnetic coil 3. The electromagnetic coil 3 is disposed around an electromagnetic coil armature system 2, where this system forms magnet yokes 3a, 3b and a magnet yoke body 13. The coil 3 is preferably wound around the yoke 3a. The yoke 3a is preferably matching the one side end of the armature 4. The diameter of the yoke 3a is preferably from about 1.5 to 3 times the thickness of the armature 4. The diameter of the yoke 3b is preferably from about 0.6 to 0.9 or preferably from about 0.75 to 0.85 times the diameter of the yoke 3a. The thickness of the armature 4 can be from about 5 to 20 times the thickness of the shaped sheet metal part 19 and is preferably from about 5 to 10 times the thickness of the shaped sheet metal part 19. The thickness of the armature 4 can be from about 0.5 to 2 times the diameter of the O-ring 24 and is preferably from 0.8 to 1.5 times the cross-sectioned thickness diameter of the O-ring 24. The length of the cog 25 can be from about 2 to 4 times, and preferably from about 2.2 to 2.8 times, the thickness of the armature 4. The cog 25 is preferably disposed at an angle of from about 85 to 95 degrees relative to the area of the shell 21 disposed on an opposite side of the armature as compared with the side of the electromagnetic coil.

The spring 10 is supported between the shell 21 and the end of the pin 1 resting on the armature 4. Preferably, the spring 10 rests at the circumference of an opening for passing the pin 1 through the shell 21 or the print pin guide case 9. The cross-section of the cog 25 is preferably nearly trapezoidal, or better, spade-like. The side of the cog 25 disposed toward the web 19c of the shaped sheet metal part is preferably a planar face of section 25b. From this planar face, inner angles of from about 95 to 110 degrees adjoin. The side of the cog 25 toward the armatures 4 engaged by the yoke 3a or 3b of the electromagnetic coil 3 is preferably formed of two planar side sections adjoining about the center at an angle from about 160 to 175 degrees and disposed opposite to the planar face of section 25b. Preferably, the cog 25 is symmetric relative to a radial plane passing through the center of the hub 12.

The tilting axis is preferably disposed about the edge of the magnet yoke 3a or 3b disposed away from the coil 3. The damper ring 11, of elastic material, can have an thickness which is from about 0.6 to 0.9 times, and preferably from about 0.75 to 0.85 times, the thickness of the armature 4. Preferably, the damper ring 11 has a rectangular cross-section, where the radial width is from about 2 to 4 times, and preferably from about 2.5 to 3.5 times, the thickness of the damper ring 11. The damper ring 11 is preferably fastened to the face of the magnet yoke body 13 near the hub 12 which is substantially planar to the end faces of the magnet yokes 3a, 3b, however, at a plane disposed rearward by from about the thickness of the damper ring 11 to 2 times the thickness of the damper ring 11. The length of the armature 4 can be from about 8 to 20 times the thickness of the armature and is preferably from about 10 to 15 times the thickness of the armature. The length of the pin 1 can be from about 1.5 to 2.5 times the length of the armature and the length of the pin 1 is preferably from about 1.8 to 2 times the length of the armature 4. The distance from the middle of the damper ring 11 to the middle of the magnet yoke 3b can be from about 1.5 to 2.5 times the distance from the middle of the yoke 3b to the yoke 3a, and is preferably from about 1.8 to 2.2 times the distance of the centers of the yokes 3a and 3b from each other. An angled section, at an angle from about 30 to 60 degrees relative to the front faces of the magnet yokes 3a, 3b, can connect the rear part of the magnet yoke to the section supporting the damper ring 11. The outer periphery of the shell 21 can be provided with a protrusion 71 at the end which engages from the outside an inner protrusion 74 of a coil support case 14 such as to provide a defined connection between the shell 21 and the coil support case 14. The print pin guide case 9 can be formed such that, in the area surrounding the pins 1, this case 9 narrows from the side where the electromagnetic coil 3 is disposed toward the side of the print support surface of the print counter support 7.

It will be understood that each of the elements described above, or two or more together, may also find a useful application in other types of structures employing hinged clapper armatures disposed along a circle and differing from the types described above.

While the invention has been illustrated and described as embodied in the context of a matrix pin print head of the hinged clapper armature construction, it is not intended to be limited to the details shown, since various modifications and structural changes may be made without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute essential characteristics of the generic or specific aspects of this invention.

What is claimed as new and desired to be protected by Letters Patent is set forth in the appended claims:

1. A matrix Pin print head comprising:

a plurality of impact pins;

a pin guide case for guiding said pins during impact operation;

a coil support case attached to said pin guide case;

a set of magnet yokes each having two arms disposed over a substantially circular circumference in said coil support case;

a set of electromagnetic coils corresponding to the number of said magnet yokes, one of said coils wound around one arm of each yoke;

a plurality of armatures, each of said armatures being disposed next to one of said yokes and actuated thereby;

each of said pins being fixedly attached at one end to one of said armatures;

a plurality of cogs distributed along the circular circumference and being an integral part of said pin guide case;

a circular shaped sheet metal part rigidly connecting all the armatures together to form one unit to eliminate any lateral movement of said armatures;

said cogs being disposed between adjacent armatures for precisely centering said unit of said armatures.

2. The matrix pin print head according to claim 1, wherein the cogs center the unit of armatures and the circular sheet metal part, and simultaneously center the unit in the coil support case.

3. The matrix pin print head according to claim 1, further comprising a joint planar face on the magnet yokes including a support face for the cogs, wherein the cogs are supported immediately on the support face for the cogs.

4. The matrix pin print head according to claim 1, further comprising a planar face on the magnet yokes, wherein the unit of armatures and said sheet metal part rests on the planar face of the magnet yokes.

5. The matrix pin print head according to claim 1, wherein the sheet metal part is provided by a leaf spring; wherein said armatures performs a pure pivoting motion on a side of the magnet yokes upon feeding current to one of the electromagnetic coils; further comprising an O-ring formed of rubber disposed next to the armatures and creating a wedge-shaped air gap between the armatures and the magnet yokes, which air gap disappears in the case of current passage, such that the armatures rest completely planar, parallel, and flat on the magnet yokes and without overshooting oscillation.

6. The matrix pin print head according to claim 1, wherein the diameter of the yoke is from about 1.5 to 3 times the thickness of the respective armature; wherein the diameter of the arm of the yoke supporting the coil is from about 0.6 to 0.9 times the diameter of a second arm of said yoke not supporting a coil; wherein the cross-section of one of the cogs matches substantially an opening defined by adjacent armatures and a section of said sheet metal part between adjacent armatures.

7. The matrix pin print head according to claim 6, further comprising an O-ring, the sheet metal part including web forming means connecting neighboring armatures to each other, wherein the diameter of the arm of yoke supporting the coil is from about 0.75 to 0.85 times the diameter of a second arm of said yoke not supporting a coil; wherein the thickness of the armatures is from about 5 to 20 times the thickness of the sheet metal part; wherein the thickness of the armature is from about 0.5 to 2 times the diameter of the O-ring; wherein the length of the cog is from about 2 to 4 times the thickness of the armature.

8. The matrix pin print head according to claim 1, further comprising an O-ring, and a shell disposed on an opposite side of the armature as compared with the side of the electromagnetic coil, wherein the cogs are disposed at an angle of from about 85 to 95 degrees relative to the area of the shell from which they project;

a damper ring adjacent to the armature wherein the damper ring is made of elastic material and has a thickness which is from about 0.6 to 0.9 times the thickness of the armature; wherein the radial width of the damper ring is from about 2 to 4 times the thickness of the damper ring; wherein the outer periphery of the shell is provided with a protrusion at the end which protrusion engages from the outside an inner protrusion of a coil support case such as to provide a defined connection between the shell and the coil support case;

wherein the thickness of the armature is from about 5 to 10 times the thickness of the shaped sheet metal part; wherein the thickness of the armature is from 0.8 to 1.5 times the cross-sectioned thickness diameter of the O-ring; wherein the length of the cog is from about 2.2 to 2.8 times the thickness of the armature; wherein the length of the armature is from about 8 to 20 times the thickness of the armature;

a plurality of springs supported between the shell and one end of each print pin; wherein the length of the print pins is from about 1.5 to 2.5 times the length of the armature;

wherein the distance from the middle of the damper ring to the middle of the magnet yoke arm not supporting a coil is from about 1.5 to 2.5 times the distance from the middle of the yoke arm supporting a coil to the middle of the yoke arm not supporting a coil.

9. Matrix pin print head according to claim 8, further comprising an opening for passing each impact pin through the shell; wherein each spring rests at the circumference of the opening; wherein the cross-section of the cog is nearly trapezoidal and the side of the cog disposed toward the sheet metal part is a planar face; wherein the cog is symmetric relative to a radial plane passing through the center of the sheet metal part; a tilting axis is disposed about the edge of the magnet yoke not supporting a coil; wherein the damper ring made of elastic material has a thickness which is from about 0.75 to 0.85 times the thickness of the armature; said damper ring has a rectangular cross-section and is fastened to the magnet yoke body; wherein the length of the armature is from about 10 to 15 times the thickness of the armature; wherein the length of the print pin is from about 1.8 to 2 times the length of the armature; wherein the distance from the middle of the damper ring to the middle of the magnet yoke arm not supporting a coil is from about 1.8 to 2.2 times the distance from the middle of the yoke arm supporting a coil to the middle of the yoke arm not supporting a coil.

10. The matrix pin print head according to claim 8, further comprising an angled section disposed at an angle from about 30 to 60 degrees relative to the front faces of the magnet yoke arms and connects the rear part of the magnet yoke to a section supporting the damper ring; said print pin guide case is formed such that, in the area surrounding the print pins, the case narrows from the side wherein the electromagnetic coil is disposed toward the side of a print impact surface.

11. The matrix pin print head according to claim 1, wherein a cross-section of the cog along a plane disposed parallel to the faces of the magnet yokes is spade-like.

12. The matrix pin print head according to claim 1, wherein the cogs, for centering the unit of armatures and the sheet metal part in the pin guide case, are fitted for simultaneously centering the unit in the coil support case; said print head further comprising a joint planar face on the magnet yokes which forms a support face for the cogs, wherein the cogs are supported immediately on the joint planar face of the magnet yokes.

* * * * *